US009290026B2

(12) United States Patent
Nagashima et al.

(10) Patent No.: US 9,290,026 B2
(45) Date of Patent: Mar. 22, 2016

(54) PRINTER

(71) Applicant: Brother Kogyo Kabushiki Kaisha, Nagoya-shi, Aichi-ken (JP)

(72) Inventors: Yuki Nagashima, Nagoya (JP); Takamine Hokazono, Kasugai (JP); Hidenori Jo, Nagoya (JP); Kenji Kurita, Kariya (JP); Minoru Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/577,634

(22) Filed: Dec. 19, 2014

(65) Prior Publication Data

US 2015/0246568 A1 Sep. 3, 2015

(30) Foreign Application Priority Data

Feb. 28, 2014 (JP) ..... 2014-038946

(51) Int. Cl.
*B41J 2/01* (2006.01)
*B41J 15/04* (2006.01)

(52) U.S. Cl.
CPC ..... *B41J 15/042* (2013.01)

(58) Field of Classification Search
CPC ..... B41J 11/58; B41J 15/00; B41J 15/02; B41J 15/04; B41J 15/042; B41J 11/007; B41J 11/06; B41J 11/0085; B41J 13/103; B41J 11/0065; B65H 16/00–16/106
USPC ..... 347/104, 101
See application file for complete search history.

(56) References Cited

U.S. PATENT DOCUMENTS 2,908,449 A * 10/1959 Bolger ..... 242/596.1
2003/0230666 A1* 12/2003 Chlipalski ..... A47K 10/40 242/596.4
2013/0105617 A1 5/2013 Kita et al.

FOREIGN PATENT DOCUMENTS

JP S55-180652 U 12/1980
JP 2002-003023 A 1/2002
JP 2013-095049 A 5/2013
JP 2013220878 A * 10/2013

* cited by examiner

*Primary Examiner* — Manish S Shah
*Assistant Examiner* — Yaovi Ameh
(74) *Attorney, Agent, or Firm* — Banner & Witcoff, Ltd.

(57) ABSTRACT

A printer includes a printing portion, two plate-shaped first support portions, a moving portion, a restricting portion, and two second support portions. The first support portions are disposed opposite one another and support opposite ends of the roll. The moving portion supports the first support portions movably. The restricting portion restricts movement of the first support portions. The second support portions support the ends of the roll. Each second support portion includes a pivoting portion, a projecting portion, and an energizing portion. The pivoting portion is supported pivotally. The projecting portion projects from the pivoting portion in a direction that intersects an axis parallel to the plane of an associated first support portion. The energizing portion energizes the pivoting portion in a direction in which the pivoting portion pivots such that the projecting portion projects from the side of the first support portion that faces the opposing first support portion.

4 Claims, 10 Drawing Sheets

PRINTER

CROSS-REFERENCE TO RELATED APPLICATION

This Application claims priority to Japanese Patent Application No. 2014-038946 filed Feb. 28, 2014, the content of which is hereby incorporated by reference.

BACKGROUND

The present disclosure relates to a printer in which can be mounted a roll around which a printing medium is wound.

A printer is known in which can be mounted a roll around which a printing medium such as a label form or the like is wound. For example, a printer is known that is provided with a form holder that has two presser plates that can be disposed at opposite ends of a form roll. The two presser plates face one another. Each one of the two presser plates is provided with a boss that projects toward the other presser plate. Each one of the two presser plates is provided with a rack gear. Each one of the two rack gears engages with a pinion gear. A compression spring energizes the presser plate on one side toward the presser plate on the other side. In a case where the presser plate on one side has been moved toward the presser plate on the other side by the compression spring, the presser plate on the other side is moved toward the presser plate on the one side by the rack gear and the pinion gear. Therefore, the two presser plates come into contact with the form roll from the opposite ends and support the form roll by clamping it at both ends. The two bosses protrude, from the opposite ends, into the cylindrical core of the form roll around which the printing medium is wound, thus holding the form roll in place against the presser plates. Each one of two stoppers restricts the movement of the corresponding one of the two presser plates toward the other presser plate anymore.

SUMMARY

With the form holder that is described above, when the form roll has been removed from the printer, each one of the two presser plates is moved toward the other presser plate by the compression spring. The distance between the two presser plates becomes shorter than the width of the form roll that has been removed. For example, in a case where a form roll will be mounted that is the same size as the form roll that has been removed, even though there is no need to change the positions of the two presser plates, a user must perform an operation of widening the distance between the two presser plates when mounting the form roll, which is burdensome.

On the other hand, a method is conceivable by which the stoppers would be used to hold the two presser plates in a state in which they are separated from one another by a distance that is equal to the width of the form roll. However, even in that case, the user would have to perform the operation of widening the distance between the two presser plates when removing the form roll, in order to move the two bosses outward from inside the core of the form roll.

Thus, with the form holder that is described above, the operations when the user removes the mounted form roll and mounts a different form roll of the same size are burdensome.

Various embodiments of the broad principles derived herein provide a printer that is capable of simplifying the operations when the user removes a mounted form roll and mounts a different form roll of the same size.

The printer according to the present disclosure includes a printing portion, a storing portion, two first support portions, a moving portion, a restricting portion, and two second support portions. The printing portion is configured to print on a printing medium. The storing portion is configured to contain a roll in which the printing medium is wound around a cylindrical core. The two first support portions are provided inside the storing portion and are plate-shaped members that are disposed opposite one another. The two first support portions are configured to move, and are configured to support opposite ends of the roll in an orthogonal direction. The orthogonal direction is orthogonal to a direction in which the printing medium is pulled out from the roll. The moving portion supports the two first support portions movably in an opposition direction. The opposition direction is the direction in which the two first support portions are disposed opposite one another. The restricting portion restricts the moving of the two first support portions by the moving portion. Each of the two second support portions is provided on each of the two first support portions. The two second support portions are configured to support the ends of the core in the opposition direction. Each of the two second support portions includes a pivoting portion, a projecting portion, and a first energizing portion. The pivoting portion is supported pivotally, with an axis that extends parallel to the plane of the first support portion serving as a pivot point. The projecting portion projects from the pivoting portion in a direction that intersects the axis. The first energizing portion energizes the pivoting portion in a direction in which the pivoting portion pivots such that the projecting portion projects from the side of the first support portion that faces the opposing first support portion.

BRIEF DESCRIPTION OF THE DRAWINGS

Embodiments will be described below in detail with reference to the accompanying drawings in which.

DETAILED DESCRIPTION

Figure 1:
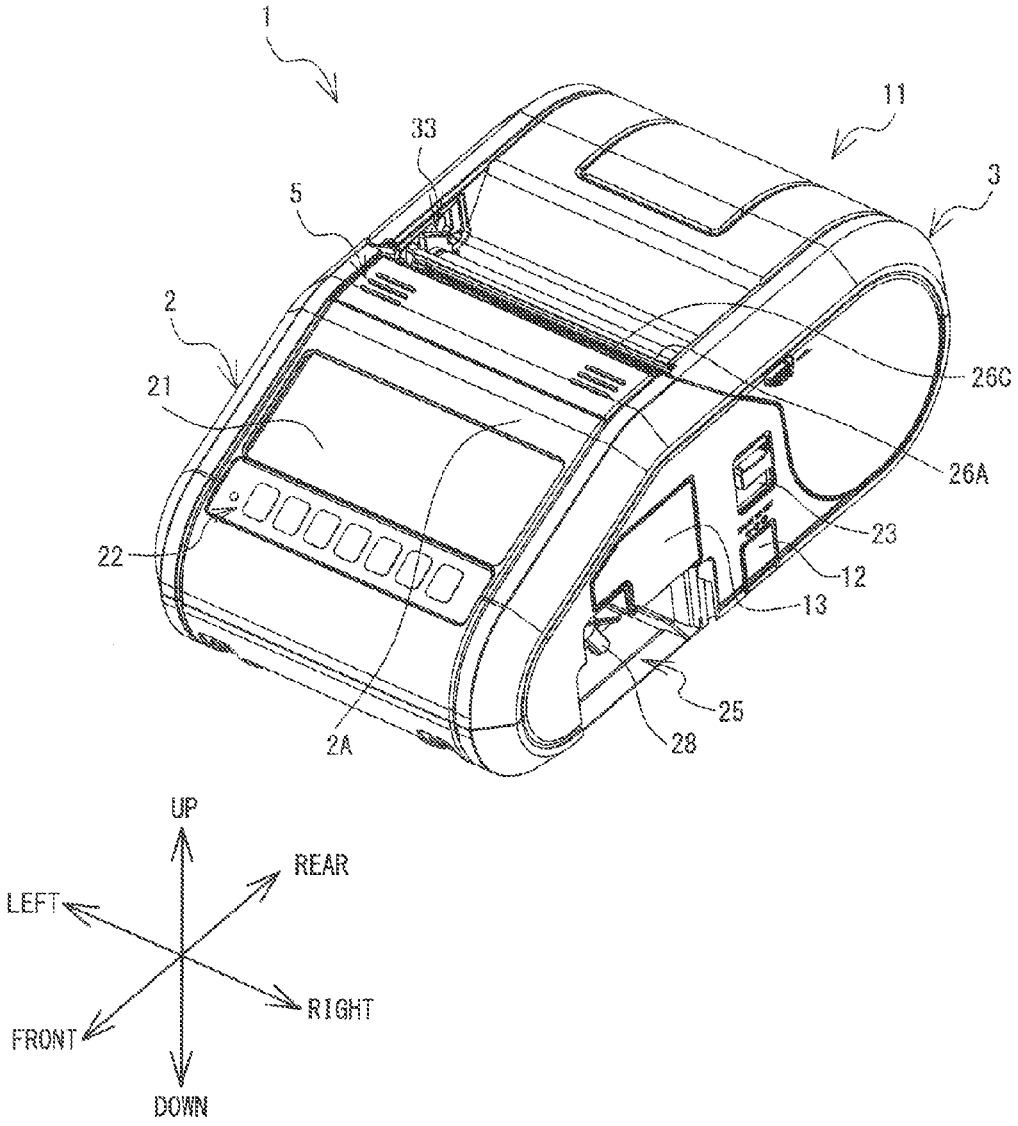
FIG. 1 is an oblique view of a printer 1 (in a state in which a cover 3 is closed)

Hereinafter, an embodiment of the present disclosure will be explained with reference to the drawings. Note that the drawings are used for explaining technological features that the present disclosure can utilize. Accordingly, device configurations and the like that are shown in the drawings are merely explanatory examples and do not serve to restrict the present disclosure to those configurations and the like, unless otherwise indicated specifically. A printer 1 can be connected to an external terminal (not shown in the drawings) through a USB (registered trademark) cable. The printer 1 is capable of printing text characters, graphics, and the like on a printing medium, based on printing data that the printer 1 receives from the external terminal. The printing medium is a heat-sensitive label. The external terminal is a general-purpose personal computer (PC). The lower right side, the upper left side, the upper right side, the lower left side, the top side, and the bottom side in FIG. 1 respectively define the right side, the left side, the rear side, the front side, the top side, and the bottom side of the printer 1.

Overview of Printer 1

Figure 2:
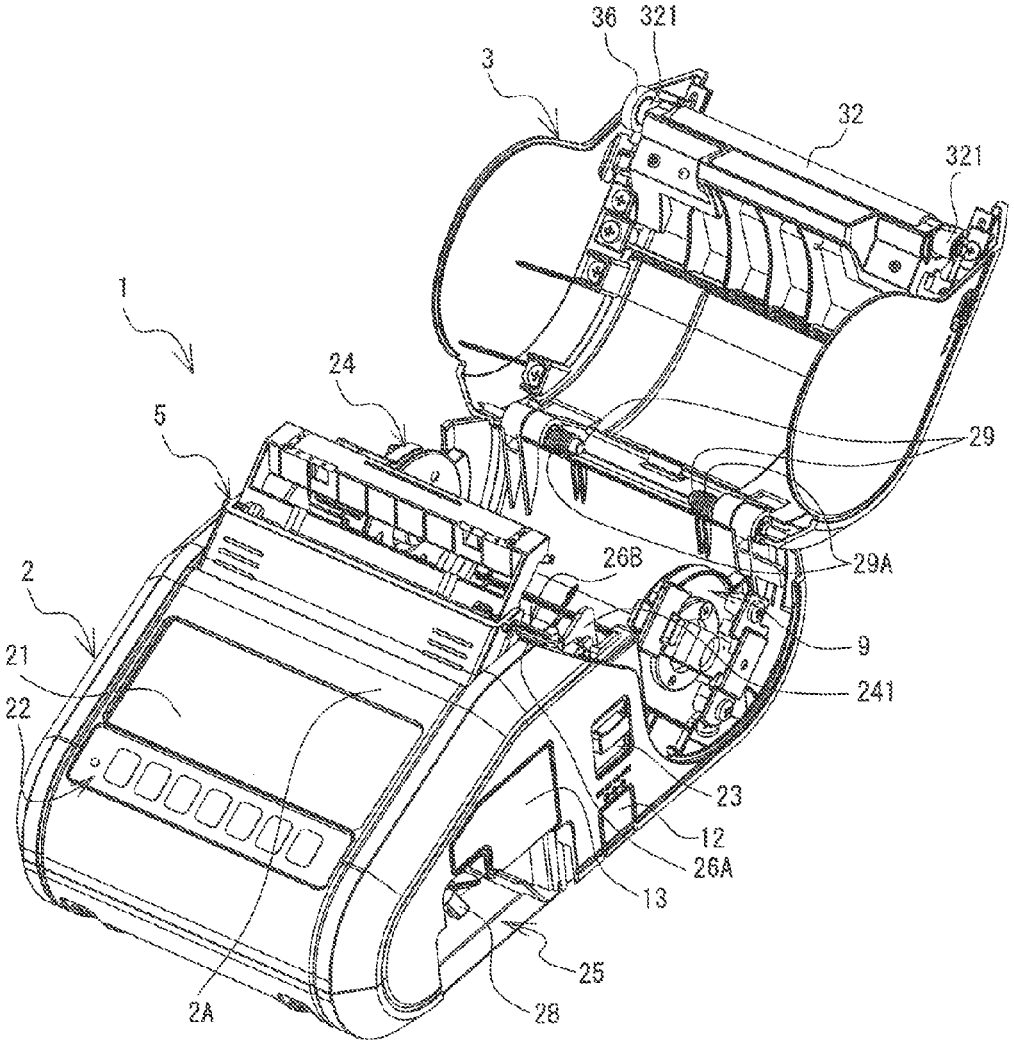
FIG. 2 is an oblique view of the printer 1 (in a state in which the cover 3 is open)

An overview of the printer 1 will be explained with reference to FIGS. 1 and 2. The printer 1 is provided with a body 2. The body 2 is provided with a control portion (not shown in the drawings), a printing portion 26B, a drive portion (not shown in the drawings), and the like in its interior. The control portion includes a CPU that controls the entire printer 1. The printing portion 26B is a line thermal head that is capable of performing printing on a heat-sensitive label. The drive portion is a motor for conveying the heat-sensitive label. The body 2 is provided with a display portion 21 and a switch 22 on an inclined portion 2A toward the front of the top side. The body 2 is provided with a peeling mechanism 5 to the rear of the display portion 21 on the inclined portion 2A. The body 2 is provided with a storing portion 24 to the rear of the peeling mechanism 5. On its right side, the body 2 is provided with an electric power supply portion 12, a USB (registered trademark) interface (I/F) 13, a lever 23, a storing portion 25, a body securing portion 28, and the like.

Figure 3:
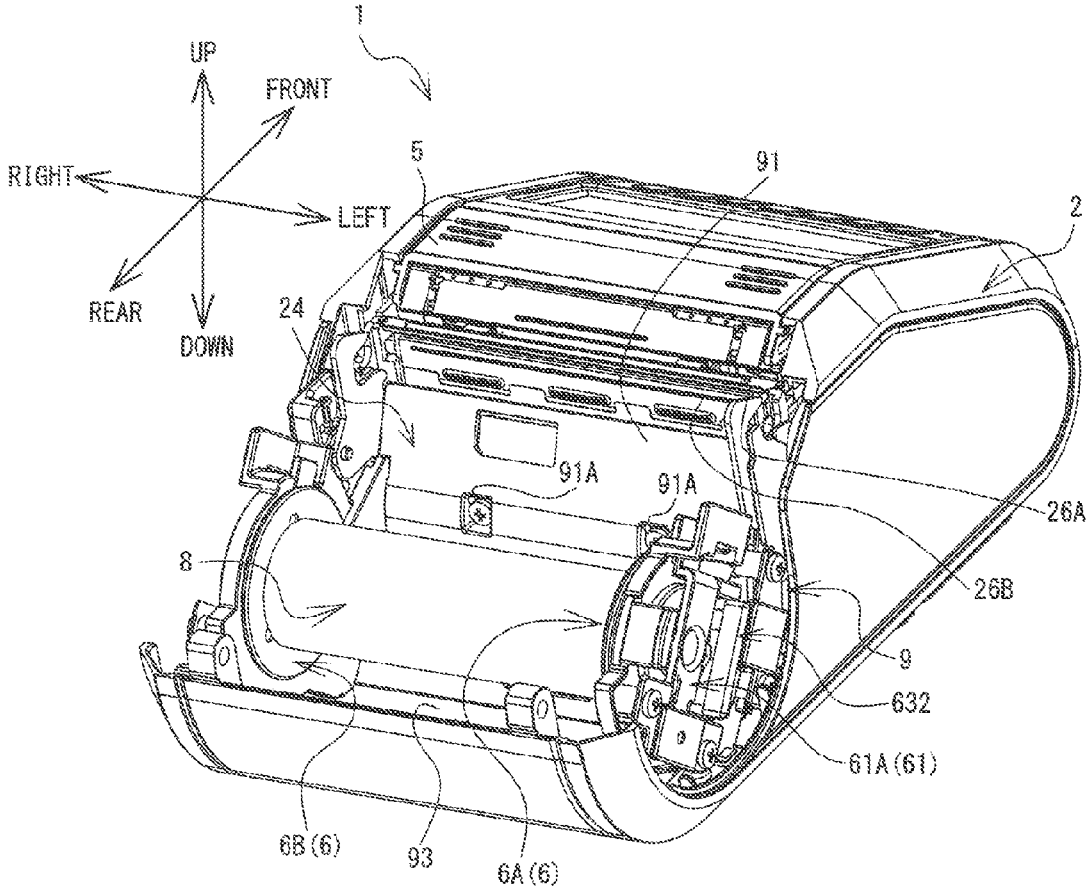
FIG. 3 is an oblique view of a form holder 9 and a roll 8 inside a storing portion 24.

The storing portion 24 is able to contain a roll 8 (refer to FIG. 3), around a cylindrical core of which is wound a release paper to which a heat-sensitive label is affixed. Hereinafter, the release paper and the heat-sensitive label will be called the tape. The left and right sides and the top side of the storing portion 24 are open. A form holder 9 is fixed in place inside the storing portion 24. The form holder 9 holds the roll 8. A cutting portion 26A is provided on the upper edge of a wall on the front side of the storing portion 24. The printing portion 26B is provided below the cutting portion 26A. The cutting portion 26A is a cutting edge that is able to cut away the printed portion of the tape. The cutting portion 26A and the printing portion 26B extend in the left-right direction. A pair of engaging portions 241 project toward the rear from the left and right ends of the wall on the front side of the storing portion 24. Each one of the pair of the engaging portions 241 is provided with a first extending portion that extends upward and a second extending portion that extends toward the front from the upper end of the first extending portion. Each one of the pair of the engaging portions 241 is able to pivot, with its lower end serving as a stationary support. When the lever 23 is pressed downward, each one of the pair of the engaging portions 241 pivots such that the upper end of its first extending portion moves toward the rear.

A cover 3 is supported by a support shaft 29 that is provided on the rear edge of the storing portion 24, such that the cover 3 can pivot around the support shaft 29. The cover 3 can pivot to anchor position where it covers the storing portion 24 from above and from the right side and the left side. Energizing portions 29A are wound around the support shaft 29. The energizing portions 29A are springs. The energizing portions 29A energize the cover 3 from a state in which it covers the storing portion 24 toward a state in which it does not cover the storing portion 24. Hereinafter, the state in which the cover 3 covers the storing portion 24 will be called the closed state of the cover 3, and the state in which the cover 3 does not cover the storing portion 24 will be called the open state of the cover 3.

The edge of the cover 3 that is on the opposite side from the edge that is supported by the support shaft 29, that is, the front edge of the cover 3 in its closed state, supports a first roller 32 such that the first roller 32 can rotate. A rotating shaft of the first roller 32 extends in the left-right direction. A pair of engaged portions 321 extend outward to the left and the right from the left and right ends, respectively, of the rotating shaft of the first roller 32. Each one of the pair of the engaged portions 321 has a circular cylindrical shape. A gear 36 is provided on the left side of the engaged portion 321 on the left side. In the closed state of the cover 3, each one of the pair of the engaged portions 321 engages with the second extending portion of the corresponding one of the pair of the engaging portions 241. At this time, the pivoting of the cover 3 from the closed state to the open state is inhibited by the engaging portions 241, and the closed state of the cover 3 is maintained In the closed state of the cover 3, the printing portion 26B and the first roller 32 are close to one another. In the closed state of the cover 3, a discharge outlet 26C, from which the tape is discharged, is formed between the peeling mechanism 5 and the first roller 32. In the closed state of the cover 3, the gear 36 meshes with a body gear (not shown in the drawings) that is provided in the body 2. The body gear is coupled to the drive portion of the body 2 and is able to rotate. In the closed state of the cover 3, when the body gear rotates, the gear 36 and the first roller 32 rotate in accordance with the rotation of the body gear.

In the closed state of the cover 3, when the lever 23 is pressed downward, the engaged portions 321 are released from the second extending portions of the engaging portions 241. The cover 3 is pivoted from the closed state to the open state by the energizing force of the energizing portions 29A.

The electric power supply portion 12 is a terminal for inserting a plug of an AC adaptor. The USB (registered trademark) I/F 13 includes a plurality of terminals for inserting connectors of a USB cable. The printer 1 is able to perform communication with the external terminal through the USB I/F 13. Note that in FIGS. 1 and 2, the electric power supply portion 12 and the USB I/F 13 are covered by rubber covers. The storing portion 25 is able to contain a battery (not shown in the drawings). The printer 1 can be driven by electric power that is supplied by the electric power supply portion 12 and by electric power that is supplied by the battery that is contained in the storing portion 25. Furthermore, the printer 1 can use the electric power that is supplied from the electric power supply portion 12 to charge the battery that is contained in the storing portion 25. The body securing portion 28 holds the battery that is contained in the storing portion 25 such that the battery does not come out of the body 2. The lever 23, the electric power supply portion 12, the USB I/F 13, and the storing portion 25 are disposed in a cluster on the right side face of the printer 1. A user is therefore able to easily perform the operations of the printer 1 that are performed through the lever 23, the electric power supply portion 12, the USB I/F 13, and the storing portion 25.

An overview of a case in which printing is performed on the heat-sensitive label will be explained. The roll 8 is held in the form holder 9, and the cover 3 is closed. The tape from the roll 8 is passed upward between the printing portion 26B and the first roller 32 from below. The first roller 32 presses the tape against the printing portion 26B with a specified force. The rotating of the first roller 32 in conjunction with the operating of the drive portion causes the tape to be continuously fed off of the roll 8 and conveyed upward from below. The up-down direction of the printer 1 corresponds to the direction in which the tape is conveyed. Furthermore, the left-right direction of the printer 1 corresponds to an orthogonal direction that is orthogonal to the direction in which the tape is conveyed. At the same time, a heating element of the printing portion 26B generates heat. Text characters and graphics are printed on the heat-sensitive label by the heat-generating heating element. After the printing, the tape is discharged to the outside from the discharge outlet 26C, in a state in which the heat-sensitive label is affixed to the release paper. The discharged tape is cut by the cutting portion 26A. Note that the printer 1 is also able to discharge the tape to the outside from the discharge outlet 26C while using the peeling mechanism 5 to peel the printed heat-sensitive label off of the release paper.

Form Holder 9

The form holder 9 will be explained in detail with reference to FIGS. 3 to 6. The form holder 9 is provided with a plate-shaped first member 91, a second member 92, and a third member 93. The shape of the first member 91 is substantially rectangular. Two screw holes 91A are provided in the first member 91. The first member 91 is affixed to a wall on the front side of the storing portion 24 by screws that are inserted through the two screw holes 91A. Hereinafter, the directions for the printer 1 (the front side, the rear side, the left side, the right side, the top side, and the bottom side) will also be applied to the form holder 9, using the state in which the form holder 9 is affixed to the storing portion 24 as an example.

The second member 92 is connected to the lower edge of the first member 91 and extends downward toward the rear. Openings 92A, 92B, which are two rectangular openings, are formed in the second member 92. The openings 92A, 92B are disposed such that their long axes extend transversely, and they are arrayed in the left-right direction. The opening 92A is disposed to the left of the opening 92B. A separating portion 92C in a central portion in the left-right direction of the second member 92 separates the openings 92A, 92B. A third support portion 67A is disposed on the rear side of the opening 92A, and a third support portion 67B is disposed on the rear side of the opening 92B. The lengths of the third support portions 67A, 67B in the left-right direction are shorter than the respective lengths of the openings 92A, 92B in the left-right direction. Note that, as will be described in detail later, the third support portion 67A is connected through the opening 92A to a rack gear 621A that is provided on the front side of the second member 92. The third support portion 67A and the rack gear 621A hold the second member 92 between them. This configuration holds the third support portion 67A such that it is able to move to the left and the right on the rear side of the opening 92A. In addition, the third support portion 67B is connected through the opening 92B to a rack gear 621B that is provided on the front side of the second member 92. The third support portion 67B and the rack gear 621B hold the second member 92 between them. This configuration holds the third support portion 67B such that it is able to move to the left and the right on the rear side of the opening 92B.

The third member 93 extends substantially horizontally toward the rear from the side of the second member 92 that is opposite the side where the second member 92 connects to the first member 91. Two screw holes 93A are provided in the third member 93. The third member 93 is affixed to a wall on the bottom side of the storing portion 24 by screws that are inserted through the two screw holes 93A.

First Support Portions 6 and Second Support Portions 61

The form holder 9 is provided with first support portions 6A, 6B (hereinafter collectively called the first support portions 6). The first support portion 6A is connected to the third support portion 67A, and the first support portion 6B is connected to the third support portion 67B. The first support portions 6A, 6B are disposed opposite one another in the left-right direction. The left-right direction of the printer 1 corresponds to an opposition direction in which the first support portions 6A, 6B are disposed opposite one another. The shapes of the first support portions 6A, 6B are left-right minor images of one another, except for a restricting portion 63 that will be described later. Accordingly, hereinafter, only the first support portion 6A will be explained in detail.

The first support portion 6A has a circular plate-shaped side plate 68A. The plane of the side plate 68A is orthogonal to the left-right direction. The side plate 68A is provided with a circular opening 681A in its center that extends through the side plate 68A in the left-right direction. The first support portion 6A has a second support portion 61A on the left side of the side plate 68A. The second support portion 61A is provided with a pivoting portion 64A, a projecting portion 65A, and a first energizing portion 66A. The pivoting portion 64A has a rectangular plate shape. The pivoting portion 64A has a first extending portion 641A, a second extending portion 642A, and a third extending portion 643A. The first extending portion 641A extends toward the upper front from the lower rear portion of the left side face of the side plate 68A, parallel to the side plate 68A, then bends to the right and extends toward the right. The second extending portion 642A extends upward the upper front from the right edge of the first extending portion 641A, parallel to the side plate 68A, then bends to the right and extends toward the right. The third extending portion 643A extends toward the upper front from the right edge of the second extending portion 642A.

The lower rear end of the first extending portion 641A is supported by a support shaft (not shown in the drawings) such that the first extending portion 641A can pivot on the side plate 68A. The support shaft that supports the first extending portion 641A extends from the upper rear toward the lower front in a direction that is parallel to the plane of the side plate 68A. The first energizing portion 66A is provided on the lower rear end of the first extending portion 641A. The first energizing portion 66A is a spring, one end of which is connected to the side plate 68A and the other end of which is connected to the first extending portion 641A. The first energizing portion 66A energizes the pivoting portion 64A in the direction of the side plate 68A such that the upper front end of the pivoting portion 64A is energized from the left toward the right, that is, the first extending portion 641A of the pivoting portion 64A changes from a state in which it is set apart from the side plate 68A (refer to FIG. 10, described later) to a state in which it is close to the side plate 68A (refer to FIG. 9, described later). The upper front end of the pivoting portion 64A is moved toward the right by the energizing force of the first energizing portion 66A until a state is created in which the second extending portion 642A is in contact with the left side face of the side plate 68A. In this state, the first extending portion 641A extends toward the upper front from the lower rear portion of the left side of the opening 681A, and the third extending portion 643A projects to the outside of the outer edge of the side plate 68A.

The pivoting portion 64A includes the projecting portion 65A. The projecting portion 65A projects from the right side face of the first extending portion 641A in a direction that is orthogonal to the plane of the first extending portion 641A. The shape of the projecting portion 65A is a circular column. The diameter of the projecting portion 65A is less than the diameter of the opening 681A. In a state in which the first extending portion 641A extends parallel to the side plate 68A, the projecting portion 65A is passed through the opening 681A from the left side and protrudes to the right beyond the right side face of the side plate 68A.

A plate-shaped guard portion 682A is provided on the upper front side of the side plate 68A. The guard portion 682A extends toward the left from the outer edge of the upper front side of the side plate 68A, then bends and extends toward the upper front. The guard portion 682A has an opening. The third extending portion 643A of the pivoting portion 64A passes through the opening in the guard portion 682A. The leading edge of the portion of the guard portion 682A that extends toward the upper front is disposed farther to the upper front than is the leading edge of the upper front end of the third extending portion 643A. The pivoting portion 64A is able to move its upper front end toward the left until the third extending portion 643A comes into contact with the guard portion 682A.

The first support portion 6B has a side plate 68B. The side plate 68B is provided with a circular opening 681B in its center. The first support portion 6B has a second support portion 61B on the right side of the side plate 68B. The second support portion 61B is provided with a pivoting portion 64B, a projecting portion 65B, and a first energizing portion (not shown in the drawings). A plate-shaped guard portion 682B is provided on the upper front side of the side plate 68B.

Moving Portion 62

Figure 6:
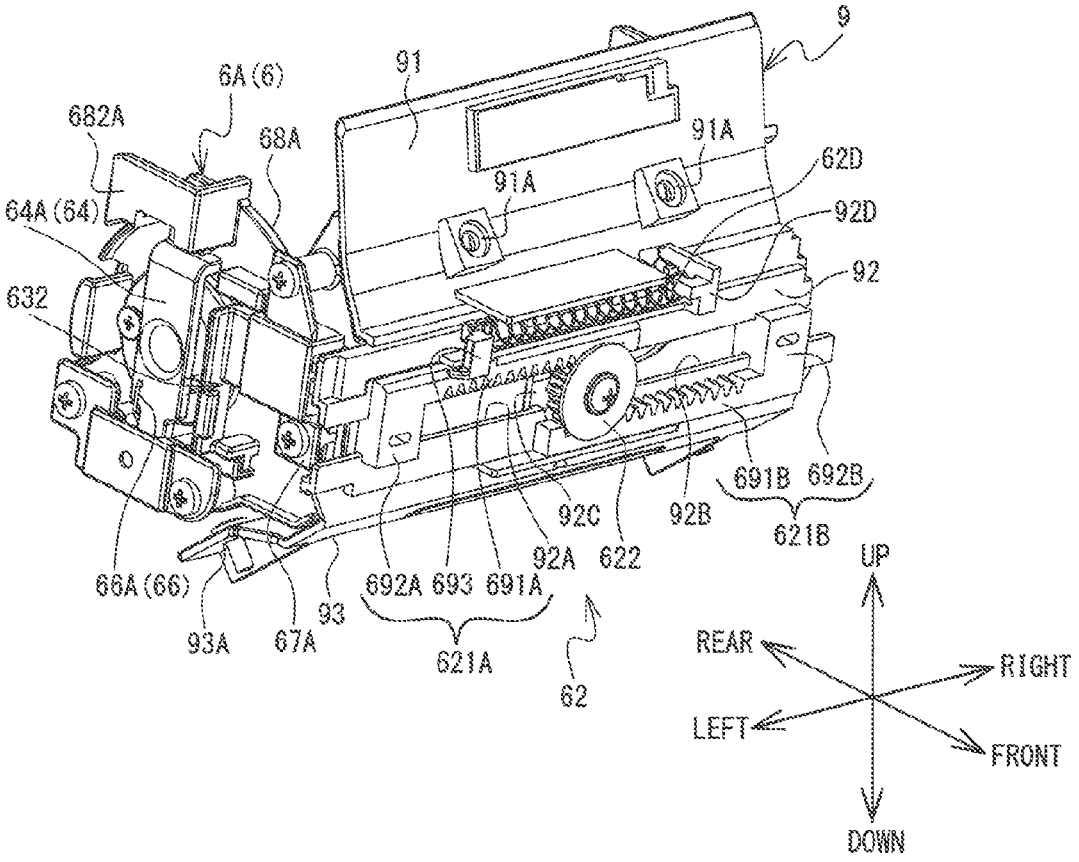
FIG. 6 is an oblique view of the form holder 9 as seen from the front.

As shown in FIG. 6, a moving portion 62 is provided on the front side of the second member 92. The moving portion 62 includes the rack gears 621A, 621B, a pinion gear 622, and a second energizing portion 62D. The rack gear 621A is provided with a first gear portion 691A, a second gear portion 692A, and a projecting portion 693. The first gear portion 691A extends in the left-right direction on the front side of the second member 92 and the upper side of the opening 92A. The first gear portion 691A is provided with a plurality of the teeth on its lower edge. The second gear portion 692A extends downward from the left end of the first gear portion 691A and is disposed in front of the opening 92A. The second gear portion 692A is connected to the first support portion 6A through the opening 92A. The projecting portion 693 projects toward the front from a position that is approximately in the center of the left-right direction of the first gear portion 691A.

The rack gear 621B is provided with a first gear portion 691B and a second gear portion 692B. The first gear portion 691B extends in the left-right direction on the front side of the second member 92 and the lower side of the opening 92A. The first gear portion 691B is provided with a plurality of the teeth on its upper edge. The second gear portion 692B extends upward from the right end of the first gear portion 691B and is disposed in front of the opening 92B. The second gear portion 692B is connected to the first support portion 6B through the opening 92B.

The pinion gear 622 is provided on the front side of the separating portion 92C of the second member 92. The pinion gear 622 is rotatably supported by a screw. The pinion gear 622 meshes with the teeth of the first gear portion 691A of the rack gear 621A from below and meshes with the teeth of the first gear portion 691B of the rack gear 621B from above.

The rack gears 621A, 621B and the pinion gear 622 of the moving portion 62 support the first support portions 6 such that the first support portions 6 can move to the left and the right. The first support portions 6A, 6B move to the left and the right in coordination with each other. For example, in a case where the first support portion 6A moves to the left by a specified amount, the rack gears 621A, 621B and the pinion gear 622 move the first support portion 6B to the right by the specified amount. That is, the rack gears 621A, 621B and the pinion gear 622 of the moving portion 62 move the first support portions 6 in one of the pair of directions that moves the first support portions 6A, 6B closer to one another (toward the inside in the left-right direction) and the pair of directions that moves the first support portions 6A, 6B farther away from one another (toward the outside in the left-right direction).

The second energizing portion 62D is provided between the projecting portion 693 of the rack gear 621A and a projecting portion 92D that extends toward the front from the upper side of the opening 92B on the front side of the second member 92. The second energizing portion 62D is a tension spring. The second energizing portion 62D causes an energizing force to act on the rack gear 621A toward the right. That is, the second energizing portion 62D energizes the first support portion 6A, which is connected to the rack gear 621A, in the direction that moves the first support portions 6A, 6B closer to one another.

Restricting Portion 63

Figure 4:
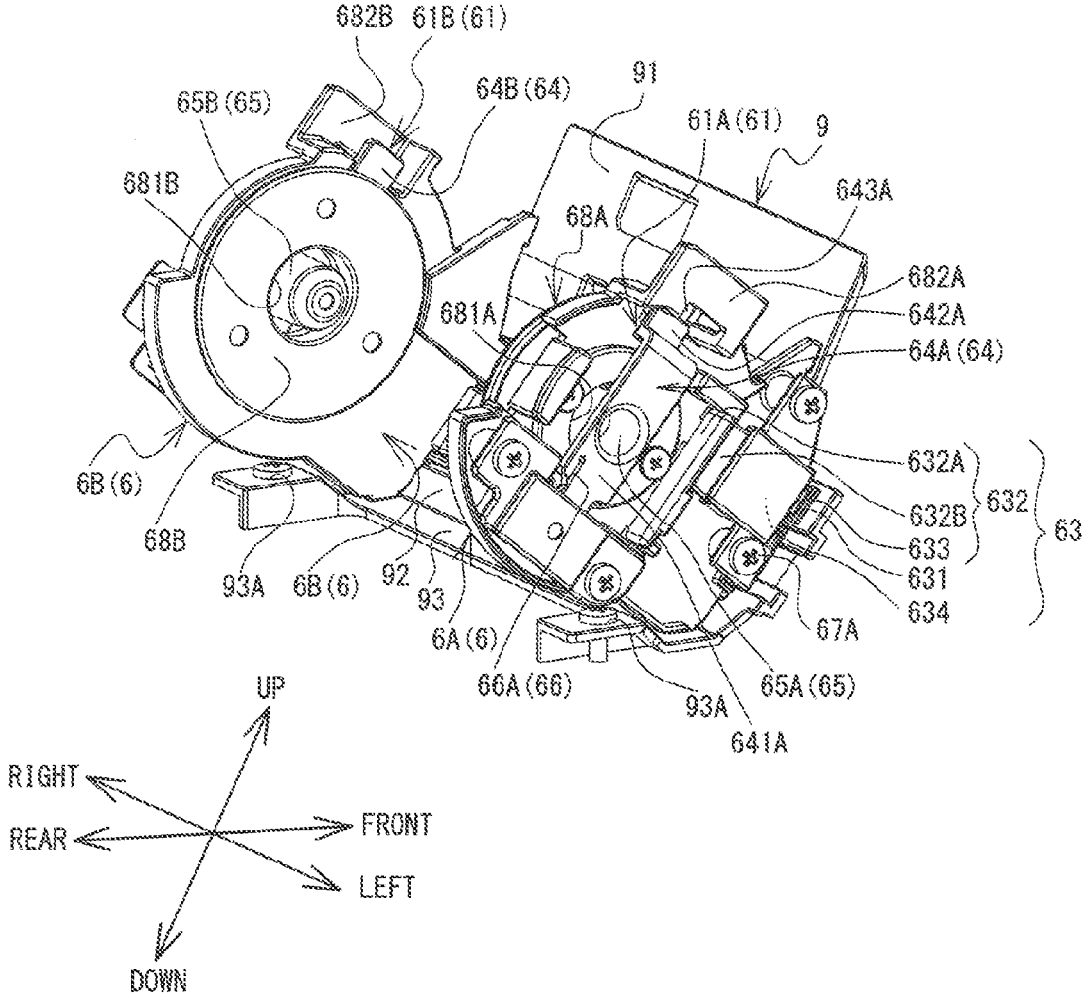
FIG. 4 is an oblique view of the form holder 9 as seen from the rear.
Figure 7:
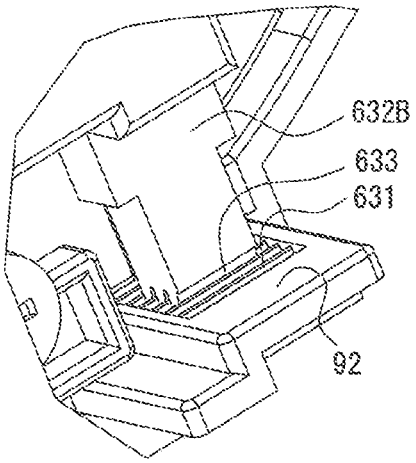
FIG. 7 is an enlarged oblique view of a comb portion 631 and a toothed portion 633.
Figure 8:
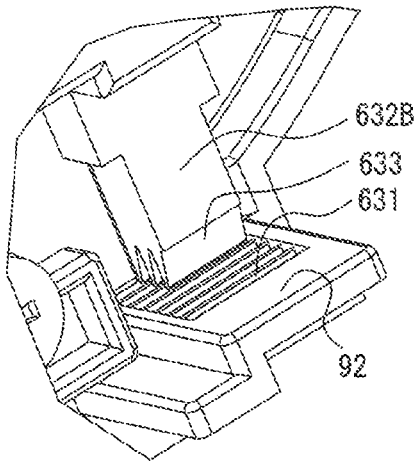
FIG. 8 is an enlarged oblique view of the comb portion 631 and the toothed portion 633.

As shown in FIG. 4, a switching portion 632 and a third energizing portion 634 are provided on the left side face of the first support portion 6A. The switching portion 632 has an operating portion 632A and an extending portion 632B. The operating portion 632A is a plate-shaped member that extends toward the upper front from the lower rear. The operating portion 632A has a flat surface on each of its upper and lower sides. The extending portion 632B extends toward the lower front from the upper half of the lower face of the operating portion 632A. The extending portion 632B is supported by a covering portion that is provided on the left side face of the first support portion 6A, such that the extending portion 632B can move. The switching portion 632 is able to move from the upper rear to the lower front and in the opposite direction. The switching portion 632 has a toothed portion 633 on the lower end of the extending portion 632B. The width of the toothed portion 633 in the left-right direction diminishes toward the tip. As shown in FIGS. 7 and 8, the toothed portion 633 protrudes downward from the covering portion that supports the extending portion 632B.

The third energizing portion 634 is provided inside the covering portion that covers the extending portion 632B. The third energizing portion 634 is a compression spring that extends in the same direction as the extending portion 632B. One end of the third energizing portion 634 is connected to the extending portion 632B, and the other end is connected to the covering portion that covers the extending portion 632B. The third energizing portion 634 causes an energizing force to act on the switching portion 632 in the direction from the upper rear side toward the lower front side.

Figure 5:
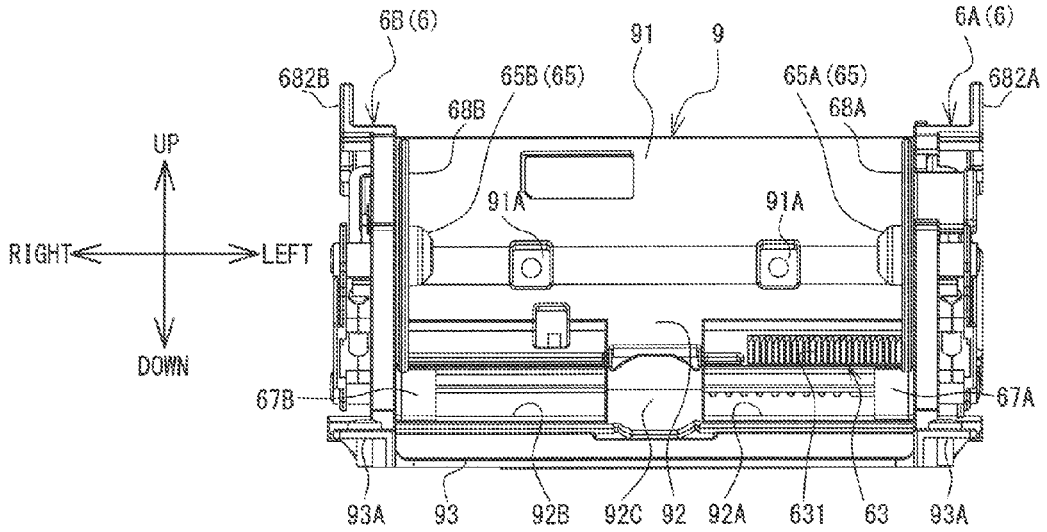
FIG. 5 is a rear view of the form holder 9.

As shown in FIG. 5, a comb portion 631 is provided on the rear face of the second member 92, on the upper side of the opening 92A. The comb portion 631 has a plurality of ridges and grooves that are arrayed at fixed intervals in the left-right direction. As shown in FIGS. 7 and 8, the toothed portion 633 of the switching portion 632 is disposed on the upper rear side of the comb portion 631.

In a case where the switching portion 632 is moved toward the lower front side by the energizing force of the third energizing portion 634, the toothed portion 633 meshes with a portion of the plurality of the ridges and grooves of the comb portion 631, as shown in FIG. 7. The switching portion 632 thus becomes unable to move in the left-right direction. Therefore, the movement of the first support portions 6A, 6B to the left and the right is restricted, even in a case where a force toward the right acts on the first support portion 6A in accordance with the energizing of the rack gear 621A toward the right by the second energizing portion 62D. On the other hand, in a case where the switching portion 632 is moved toward the upper rear side against the energizing force of the third energizing portion 634, the toothed portion 633 disengages from the plurality of the ridges and grooves of the comb portion 631, as shown in FIG. 8. The switching portion 632 thus becomes able to move in the left-right direction. Note that the second energizing portion 62D energizes the rack gear 621A toward the right, so a force toward the right acts on the first support portion 6A, and the first support portions 6A, 6B move to the left and the right. Hereinafter, the switching portion 632, the third energizing portion 634, and the comb portion 631 will be collectively called the restricting portion 63.

Procedures for Mounting and Removing the Roll 8

A procedure for mounting the roll 8 in the printer 1 will be explained. The user holds the operating portion 632A of the switching portion 632 and moves it to the upper rear side against the energizing force of the third energizing portion 634. The toothed portion 633 disengages from the comb portion 631, and the first support portions 6 become able to move to the left and the right. While keeping the operating portion 632A in the state in which it has been moved to the upper rear side, the user holds the first support portion 6A and moves the first support portions 6 such that the first support portions 6A, 6B move away from each other.

The user takes the roll 8 that will be used for printing and places it to the right of the first support portion 6A and to the left of the first support portion 6B. The user moves the first support portions 6 until the first support portions 6A, 6B respectively come into contact with the left and right ends of the roll 8, such that the distance between the side plate 68A of the first support portion 6A and the side plate 68B of the first support portion 6B becomes equal to the width of the roll 8 that will be used for printing. After adjusting the distance between the side plates 68A, 68B to be equal to the width of the roll 8, the user releases the operating portion 632A. The switching portion 632 is moved to the lower front side by the energizing force of the third energizing portion 634, and the toothed portion 633 meshes with a portion of the plurality of the ridges and grooves of the comb portion 631. The movement of the first support portions 6A, 6B toward the inside in the left-right direction is restricted by the meshing of the toothed portion 633 with the comb portion 631, so the state in which the distance between the side plates 68A, 68B is equal to the width of the roll 8 is maintained.

Note that in the procedure described above, the user, after placing the roll 8 to the right of the first support portion 6A and to the left of the first support portion 6B, may also release the first support portions 6A, 6B while maintaining the state in which the operating portion 632A has been moved to the upper rear side. Note also that the first support portions 6A, 6B are energized toward one another (toward the inside in the left-right direction) by the second energizing portion 62D. Therefore, in a case where the user releases the first support portions 6A, 6B, the first support portions 6A, 6B are automatically moved toward the inside by the second energizing portion 62D. The movement of the first support portions 6A, 6B toward the inside stops in a state in which the side plate 68A is in contact with the left end of the roll 8 and the side plate 68B is in contact with the right end of the roll 8. Thereafter, the user may release the operating portion 632A. The first support portions 6A, 6B are thus held in the state in which the distance between the side plates 68A, 68B is equal to the width of the roll 8.

The projecting portion 65A of the second support portion 61A and the projecting portion 65B of the second support portion 61B are inserted into the core of the roll 8 and support the core from both sides. In addition, the side plate 68A of the first support portion 6A and the side plate 68B of the first support portion 6B are respectively in contact with the left and right ends of the roll 8 and respectively support the roll 8 from the left and right sides. A state is thus created in which printing can be done on the heat-sensitive label that is wound around the roll 8.

Figure 9:
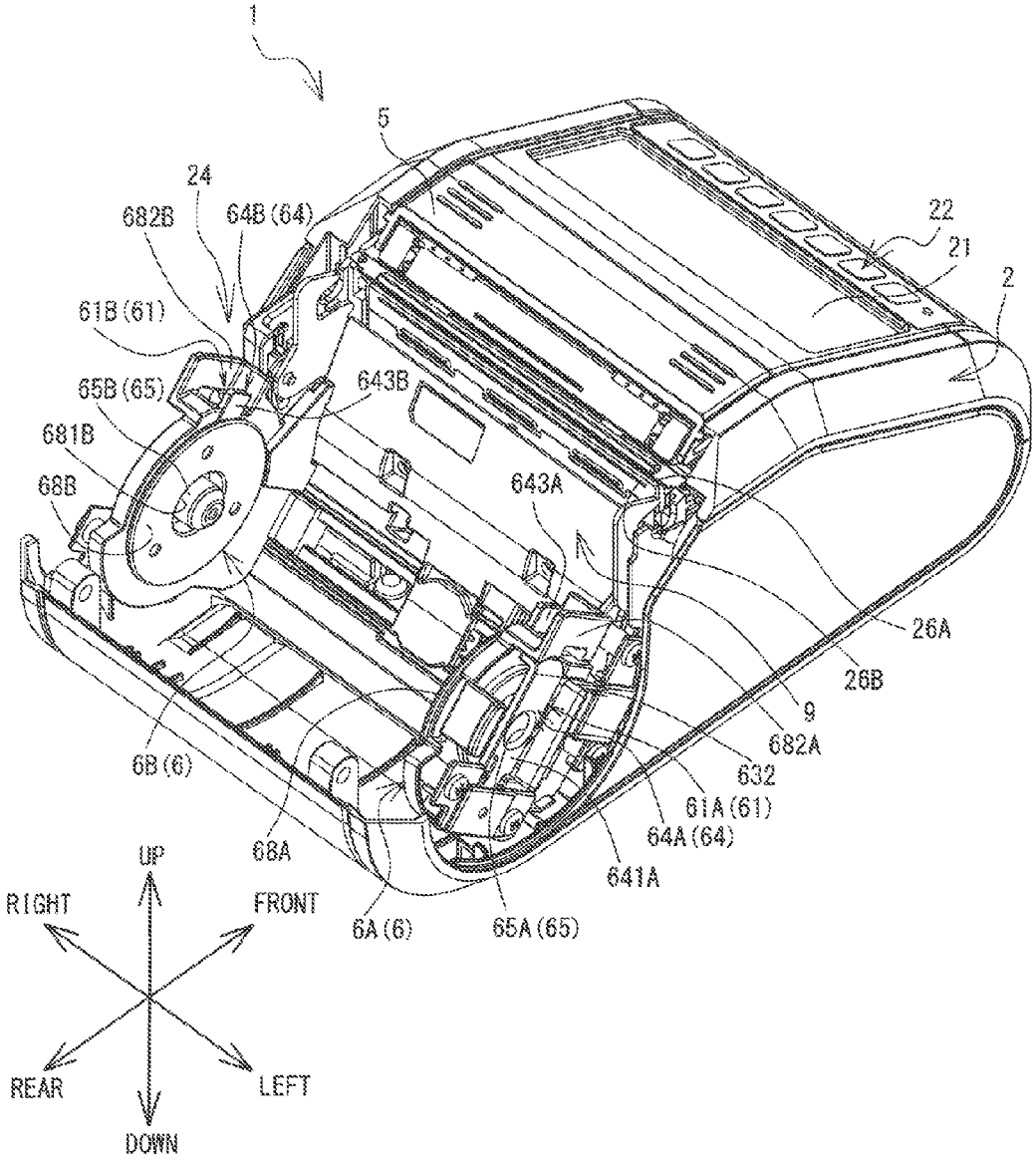
FIG. 9 is an oblique view of the form holder 9 inside the storing portion 24.

A procedure will be explained that is used in a case where the roll 8 that is mounted in the form holder 9 is replaced with a different roll 8 that has the same length in the left-right direction, with reference to FIGS. 9 and 10. In the state in which the roll 8 is mounted, before it is replaced (refer to FIG. 9, in which the roll 8 is not shown):

The user holds the third extending portion 643A of the pivoting portion 64A of the second support portion 61A and moves it to the left until the third extending portion 643A comes into contact with the guard portion 682A.

Figure 10:
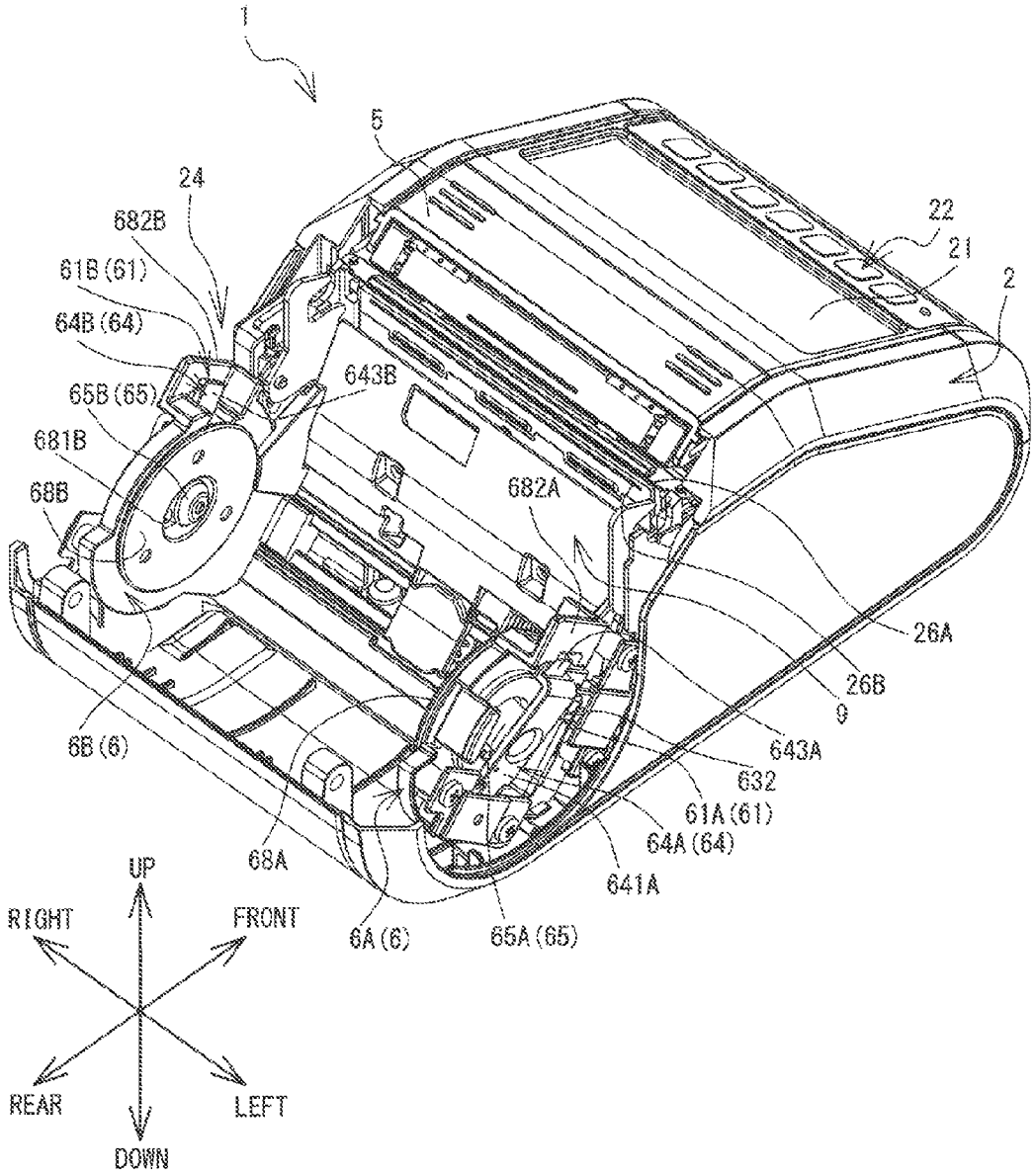
FIG. 10 is an oblique view of the form holder 9 inside the storing portion 24.

Because the moving of the third extending portion 643A toward the left causes the first extending portion 641A of the pivoting portion 64A to move away from the side plate 68A, the extent to which the projecting portion 65A projects toward the right from the side plate 68A becomes smaller (refer to FIG. 10).

In the same manner,

The user holds the third extending portion 643B of the pivoting portion 64B of the second support portion 61B and moves it to the right until the third extending portion 643B comes into contact with the guard portion 682B.

The moving of the third extending portion 643B toward the right causes the extent to which the projecting portion 65B projects toward the left from the side plate 68B to become smaller (refer to FIG. 10).

Because the extents to which the projecting portion 65A and the projecting portion 65B project from the inner sides of the side plate 68A and the side plate 68B become smaller, the projecting portions 65A, 65B come out of the inside of the core of the roll 8, so the user is able to remove the roll 8 that is in the mounted state from the form holder 9 without moving the first support portions 6A, 6B.

Note that in the procedure described above, the user may also remove the roll 8 from the form holder 9 without pivoting the pivoting portions 64 manually. Even in a case where the pivoting portions 64 are not pivoted manually, the pivoting portions 64 are automatically pivoted outward by the first energizing portions 66, so the extent to which the projecting portion 65A projects toward the right from the side plate 68A automatically becomes smaller, and the extent to which the projecting portion 65B projects toward the left from the side plate 68B automatically becomes smaller. Therefore, the user is able to remove the roll 8 from the form holder 9 even more easily.

The user mounts the different roll 8 in the form holder 9 as hereinafter described. The user moves the third extending portion 643A to the left and moves the third extending portion 643B to the right. The user mounts the different roll 8 between the first support portions 6A, 6B. Note that the movement of the first support portions 6 in the left-right direction is restricted by the restricting portion 63. The distance between the side plates 68A, 68B is therefore maintained in the state of being the same as the width of the roll 8 prior to the replacement. Furthermore, the user's pivoting of the pivoting portions 64 makes the extent to which the projecting portion 65A projects toward the right from the side plate 68A smaller and makes the extent to which the projecting portion 65B projects toward the left from the side plate 68B smaller. The user is therefore able to mount the different roll 8 between the first support portions 6A, 6B without moving the first support portions 6A, 6B to the left and the right. Because the distance between the side plates 68A, 68B is the same as the width of the mounted different roll 8, the side plates 68A, 68B are respectively in contact with the left and right ends of the roll 8 and respectively support the roll 8 from the left and right sides.

The user releases the third extending portions 643A, 643B. The pivoting portion 64A is pivoted by the energizing force of the first energizing portion 66A such that the first extending portion 641A moves close to the side plate 68A. Therefore, the extent to which the projecting portion 65A projects toward the right from the side plate 68A becomes greater. In the same manner, the pivoting portion 64B pivots, and the extent to which the projecting portion 65B projects toward the left from the side plate 68B becomes greater. Therefore, the projecting portions 65A, 65B are inserted into the core of the different roll 8 and support the core from both sides. A state is thus created in which printing can be done on the heat-sensitive label that is wound around the different roll 8 after the replacement.

As explained above, in the printer 1, the pivoting of the pivoting portion 64A causes the second support portion 61A to switch between a state in which the extent to which the projecting portion 65A projects from the inner side face of the side plate 68A is smaller and a state in which it is larger. By pivoting the pivoting portion 64A against the energizing force of the first energizing portion 66A, the user is able to switch the extent to which the projecting portion 65A projects from the inner side face of the side plate 68A between the smaller state and the larger state. The same holds true in the case of the second support portion 61B, the pivoting portion 64B, the side plate 68B, and the projecting portion 65B. Making the extents to which the projecting portions 65A, 65B project from the inner side faces of the side plates 68A, 68B smaller causes the movement of the first support portions 6A, 6B to be restricted by the restricting portion 63. The user can then easily mount the roll 8 between the first support portions 6A, 6B even if the state is maintained in which the distance between the first support portions 6A, 6B is substantially the same as the width of the roll 8 in the left-right direction. Furthermore, the energizing force of the first energizing portion 66A energizes the pivoting portions 64 in the direction in which they pivot such that the projecting portions 65A, 65B project from the opposing faces of the two first support portions 6. Therefore, after the roll 8 has been mounted, the printer 1 can easily use the energizing force of the first energizing portion 66A to switch the second support portion 61A from the state in which the extent to which the projecting portion 65A projects from the inner side face of the side plate 68A is smaller to the state in which it is larger. The same holds true in the case of the second support portion 61B, the side plate 68B, and the projecting portion 65B. Therefore, the user can easily perform the operations of removing the mounted roll 8 and mounting a different roll 8 of the same size in its place.

The rack gears 621A, 621B and the pinion gear 622 of the moving portion 62 make it possible for the printer 1 to move the first support portions 6A, 6B in coordination with one another. Furthermore, each one of the first support portions 6A, 6B is energized toward the inside by the second energizing portion 62D. Therefore each one of the first support portions 6A, 6B can easily support the roll 8 with the inner side faces of the side plates 68A, 68B, respectively.

The restricting portion 63 of the printer 1 is able to restrict the movement of each one of the first support portions 6A, 6B with the simple configuration of the comb portion 631, the switching portion 632, and the third energizing portion 634. Moreover, the switching of the toothed portion 633 of the switching portion 632 between the state in which it meshes with the comb portion 631 and the state in which it does not mesh with the comb portion 631 makes it possible for each one of the first support portions 6A, 6B to be switched easily between a state in which it can move and a state in which it cannot move.

The third energizing portion 634 causes an energizing force to act on the switching portion 632 such that the toothed portion 633 of the switching portion 632 is put into the state in which it meshes with a portion of the plurality of the ridges and grooves of the comb portion 631. Causing the energizing force to act on the switching portion 632 and putting the toothed portion 633 into the state in which it meshes with the ridges and grooves of the comb portion 631 inhibits the first support portions 6A, 6B from unintentionally being switched to the state in which they are able to move. Therefore, the restricting portion 63 is appropriately able to maintain the state in which the first support portions 6A, 6B cannot move.

Note that the present disclosure is not limited to the embodiment that is described above, and various types of modifications can be made. In the embodiment that is described above, the extent to which the projecting portion 65A projects from the inner side face of the side plate 68A is switched by the pivoting of the pivoting portion 64A. Furthermore, the extent to which the projecting portion 65B projects from the inner side face of the side plate 68B is switched by the pivoting of the pivoting portion 64B. Instead of this, the projecting portion 65A may be switched by the pivoting of the pivoting portion 64A between a state of projecting from the inner side face of the side plate 68A and a state of not projecting. In the same manner, the projecting portion 65B may be switched by the pivoting of the pivoting portion 64B between a state of projecting from the inner side face of the side plate 68B and a state of not projecting.

In the embodiment that is described above, the moving portion 62 includes the rack gears 621A, 621B and the pinion gear 622 and moves the first support portions 6A, 6B to the left and the right in coordination with each other. However, the first support portions 6A, 6B may also be moved to the left and the right by a different mechanism. For example, it is also acceptable for the rack gears 621A, 621B and the pinion gear 622 not to be connected to the third support portions 67A, 67B. In that case, it is acceptable for the first support portions 6A, 6B not to move to the left and the right in coordination with each other.

The configuration of the restricting portion 63 can be modified. For example, at least one of the first support portions 6A, 6B may have a stopper that can be switched between a state of being in contact with the second member 92 and a state of not being in contact. The user may then restrict the movement of the one of the first support portions 6A, 6B to the left and the right by switching the stopper between the state of being in contact with the second member 92 and the state of not being in contact.

It is also acceptable for the restricting portion 63 not to be provided with the third energizing portion 634. For example, the restricting portion 63 may have a holding portion that holds the switching portion 632 in the state in which the toothed portion 633 does not mesh with the comb portion 631. Then, by switching between a state in which the switching portion 632 is held by the holding portion and a state in which it is not held, the user may switch between a state in which the movements of the first support portions 6A, 6B to the left and the right are restricted and a state in which they are not restricted.

The projecting portion 65A needs only to project from the right side face of the first extending portion 641A in a direction that intersects the plane of the first extending portion 641A and does not need to project orthogonally to the plane of the first extending portion 641A. The same holds true for the projecting portion 65B. In addition to the second energizing portion 62D that energizes the rack gear 621A, an energizing portion that energizes the rack gear 621B may also be provided. The second energizing portion 62D may also be provided between the rack gears 621A, 621B.

What is claimed is:

1. A printer, comprising:

a printing portion that is configured to print on a printing medium;

a storing portion that is configured to contain a roll in which the printing medium is wound around a cylindrical core;

two first support portions that are provided inside the storing portion and that are plate-shaped members that are disposed opposite one another, that are configured to move, and that are configured to support opposite ends of the roll in an orthogonal direction that is orthogonal to a direction in which the printing medium is pulled out from the roll;

a moving portion that supports the two first support portions movably in an opposition direction that is the direction in which the two first support portions are disposed opposite one another;

a restricting portion that restricts movement of the two first support portions by the moving portion; and two second support portions, each of which is provided on each of the two first support portions, that are configured to support the ends of the core in the opposition direction, each of the two second support portions including a pivoting portion, a projecting portion, and a first energizing portion, the pivoting portion being supported pivotally, with an axis that extends parallel to a plane of a corresponding one of the two first support portions serving as a pivot point, the projecting portion projecting from the pivoting portion in a direction that intersects the axis, the first energizing portion energizing the pivoting portion in a direction in which the pivoting portion pivots such that the projecting portion projects from a side of the corresponding one of the two first support portions that faces the other one of the two first support portions, and two guard portions, each of which being provided on a corresponding one of the two first support portions, each of the two guard portions restricting pivotal movement of a corresponding pivoting portion by contacting the pivoting portion.

2. The printer according to claim 1, wherein the moving portion is provided with two rack gears, one pinion gear, and a second energizing portion, each of the two rack gears being provided on each of the two first support portions and extending in the opposition direction, the pinion gear meshing with the two rack gears, and the second energizing portion energizing at least one of the two first support portions such that the two first support portions move closer to one another.

3. The printer according to claim 1, wherein the restricting portion is provided with a comb portion and a switching portion, the comb portion being provided inside the storing portion, and the switching portion being provided in at least one of the two first support portions, being a member that is provided on one end with a toothed portion that meshes with the comb portion, and being configured to switch between a state in which the toothed portion meshes with the comb portion and a state in which the toothed portion does not mesh with the comb portion.

4. The printer according to claim 3, wherein the restricting portion is further provided with a third energizing portion that energizes the switching portion from the state in which the toothed portion does not mesh with the comb portion toward the state in which the toothed portion does mesh with the comb portion.

* * * * *